United States Patent [19]

Botz et al.

[11] Patent Number: 4,868,352

[45] Date of Patent: Sep. 19, 1989

[54] ELECTRIC SWITCH

[75] Inventors: Jakob Botz, Ingersheim; Adam Weber, Bietigheim-Bissingen, both of Fed. Rep. of Germany

[73] Assignee: SWF- Auto Electric GmbH, Bietigheim-Bissingen, Fed. Rep. of Germany

[21] Appl. No.: 181,293

[22] PCT Filed: Jun. 27, 1987

[86] PCT No.: PCT/EP87/00350

§ 371 Date: Apr. 11, 1988

§ 102(e) Date: Apr. 11, 1988

[87] PCT Pub. No.: WO88/00389

PCT Pub. Date: Jan. 14, 1988

[30] Foreign Application Priority Data

Jul. 3, 1986 [DE] Fed. Rep. of Germany ..... 3622289

[51] Int. Cl.[4] ..... H01H 9/00

[52] U.S. Cl. ..... 200/4

[58] Field of Search ..... 200/4, 11 C, 11 R, 43.03, 200/5 R

[56] References Cited

U.S. PATENT DOCUMENTS 4,298,776 11/1981 Sondermann ..... 200/4

FOREIGN PATENT DOCUMENTS 846575 8/1952 Fed. Rep. of Germany .
1118627 11/1961 Fed. Rep. of Germany .
1908799 1/1970 Fed. Rep. of Germany .
2002734 7/1971 Fed. Rep. of Germany .
2533802 2/1977 Fed. Rep. of Germany .
2726287 12/1978 Fed. Rep. of Germany .
3113892 10/1982 Fed. Rep. of Germany .

*Primary Examiner*—Roy N. Envall, Jr.
*Attorney, Agent, or Firm*—Robert P. Seitter

[57] ABSTRACT

An improved ignition switch for motor vehicles comprises a common fixed contact, several independent fixed contacts, and several movable bridging contacts. The bridging contacts are individually operated by tappets driven by cams on a rotatable operating member. Guide sleeves mounted in a guide plate restrict the tappet to displacements exclusively in parallel to the axis of rotation of the operating member, thereby preventing transmission of side forces to the bridging contacts. The tappets are unattached to the bridging contacts and guide plates are provided for the bridging contacts to further minimize sideways displacement of these contacts due to off center tappet application. Closing pressure is supplied to the rigid bridging contacts by a separate spring to provide consistent pressure regardless of contact temperature. Bridging contacts, tappets, and guide sleeves are located in parallel to facilitate alignment. The common fixed contact comprises at least two connection arms for attaching power supply cables. The common fixed contact has a flange to improve heat radiation; tappets are made of temperature resistant, heat insulating plastics to prevent damage from high temperatures generated at the contacts.

13 Claims, 4 Drawing Sheets

FIG. 4
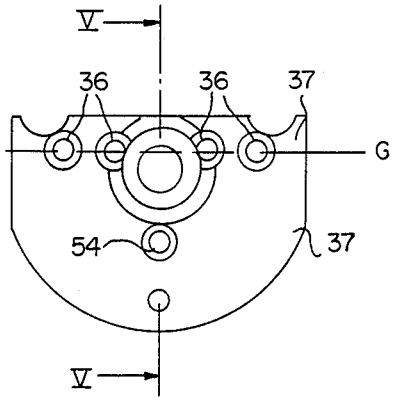
FIG. 5
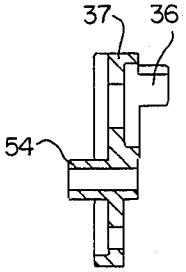
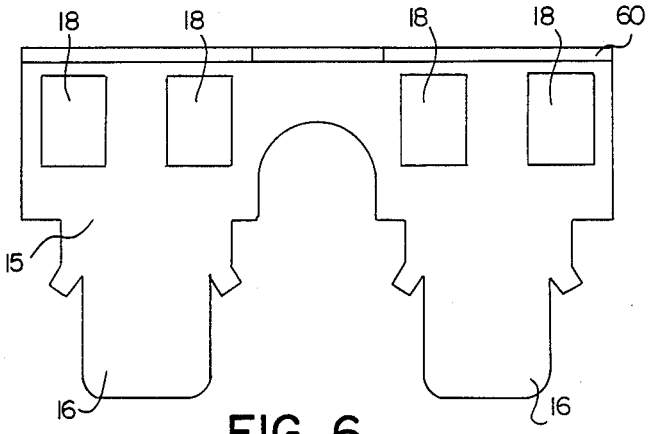
FIG. 6
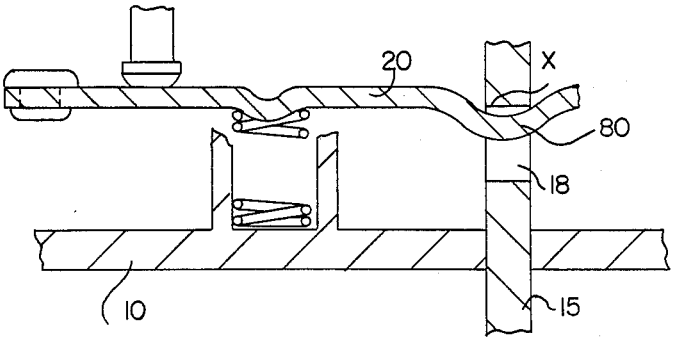
FIG. 7

ELECTRIC SWITCH

BACKGROUND OF THE INVENTION

The present invention relates to electric switches, and more particularly to ignition starter switches having fixed contacts which may be electrically connected by a tappet-controlled movable bridging contact.

Prior-art German specification DE-AS No. 1 908 799 discloses an ignition starter switch for motor vehicles comprising fixed contacts fastened to a base plate which contacts can electrically be connected by a movable bridging contact. These bridging contacts are formed as leaf springs producing the contact closing pressure. Such a switch is not appropriate for currents higher than 50 A, because the resilient qualities of the leaf springs decrease due to the heat produced at such high currents. This degrades the contact closing pressure and the resistance between the contacts.

The switch disclosed in prior-art German specification DE-AS No. 1 908 799 has a rotatable operating member which carries operating cams on its front face. The cams act on a tappet, one end of which is attached to the bridging contact or leaf spring. The other end of the tappet lies on the operating cam. When the operating member rotates, forces act circumferentially on the tappet. These forces are transmitted to the bridging contact because of the secure attachment of the tappet to the bridging contact. This may increase the contact resistance.

The object of this invention is to improve the switch disclosed in the prior-art German specification DE-AS No. 1 908 799 so that it may be used for higher currents.

According to the invention this object is achieved by confining the tappet in a guide sleeve disposed in parallel to the axis of rotation of the operating member and attached to a guide plate. This configuration eliminates transmission to the bridging contact of side forces through the tappet. When the operating member is rotated, the rotation is transformed exclusively into a shifting movement of the tappet in parallel to the axis of rotation of the operating member. Hence, canting of the bridging contact is impossible.

The tappet may be advantageously formed as a separate part that is not attached to the bridging contact. Thus, even if the tappet becomes loose within the guide sleeve due to wear, transmission of the side forces to the bridging contact remains impossible.

In addition, the tappet may be advantageously disposed such that it acts on the bridging contact only by means of one of its free front faces. The bridging contact is preferably guided in parallel to the axis of rotation of the operating member via guide walls extending perpendicularly to the base plate. By providing means for guiding the bridging contact which are independent from the tappet guide means, the direction of movement of the bridging contact is not influenced by errors in the direction of the tappet guide sleeve.

In a switch with these features, no forces deviating from the desired direction of movement act on the bridging contact. Thus, a rigid bridging contact may be used, with sufficient contact closing pressure provided by a separate spring. The bridging contact may then be optimized for low resistance and good heat dissipation without affecting the contact closing pressure since that pressure is produced by a separate spring.

In typical ignition starter switch applications, different consumers must be connected with the same pole of a voltage source in different switching positions. To accommodate this requirement, a switch according to the invention may be constructed comprising several bridging contacts located in parallel. On one side, the bridging contacts are electrically connected to one single fixed contact. On the other side, each bridging contact acts in combination with one separate fixed contact. Preferably The fixed contact which all bridging contacts have in common integrally comprises at least two contact arms for connecting one electric cable each. This eliminates the need for special cables with a larger-than-ordinary cross section even for highly-loaded switches. In such a switch, each bridging contact is preferably operated by a separate tappet, and the guide sleeves for all tappets are located along a straight line in the guide plate. This allows the corresponding operating cams of the operating member to be placed on concentric circles with different radii. As a result, small switching angles may be used, and the switch assembly may be made compact.

BRIEF DESCRIPTION OF THE DRAWINGS

Preferred embodiments according to the invention are illustrated in the following drawings in which:

FIG. 4 is a view of the guide plate;

FIG. 5 is a section of the guide plate taken along the line V—V in FIG. 4;

FIG. 6 is a view of the fixed contact which all bridging contacts have in common; and FIG. 7 is a detailed view of the attachment of a bridging contact to the common fixed contact in an alternative preferred embodiment.

DESCRIPTION OF THE PREFERRED EMBODIMENTS

Figure 1:
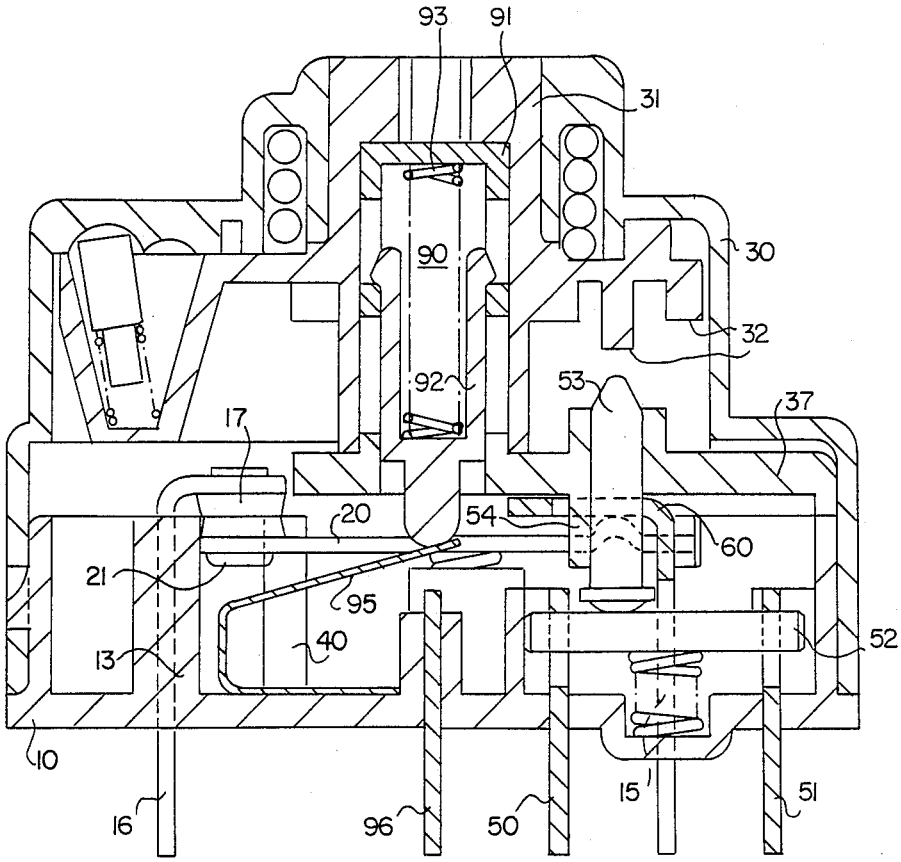
FIG. 1 is a longitudinal section of a switch according to the invention.

A preferred embodiment is shown in FIGS. 1–6. A guide plate 10 made of temperature-proof plastics carries several fixed contacts 11, 12, 13, 14 and 15, which are punched out of a blank made of a suitable conducting material. Fixed contacts 11 to 14 each have a contact arm 16 at one of their ends for connecting to a connector plug terminating an electrical cable. At the other end, each fixed contact has a contact rivet 17 made of precious metal. According to FIG. 6, fixed contact 15 has two contact arms 16, 16' for connecting two separate cables each of which is connected to the same pole of a voltage source. Several slots 18 are worked into fixed contact 15. One end of each rigid bridging contact 20 is inserted into each slot 18. At the other end, each rigid bridging contact 20 also carries a contact rivet 21 which acts in combination with a contact rivet 21 of one of the fixed contacts 11, 12, 13 or 14. A spiral spring 22 generating the necessary contact closing pressure is supported by the base plate 20.

A switch housing 30 is locked with the base plate 10, in which housing there is a rotatable operating member 31. This rotatable operating member 31 carries radial cams or operating cams 32 on its front face. Cams 32 are located on concentric circles of different radii, centered on the axis of rotation of the operating member 31. Cams 32 each act in combination with corresponding tappets 35. The tappets are displaceably guided in parallel to the axis of rotation of the operating member 31 in guide sleeves 36 attached a guide plate 37. Guide plate 37 is fixed within the switch housing 30 and does not rotate. Each tappet has, at one end, a cap 38 in the form of a truncated core that is rounded at the end. Each cap acts in combination with a corresponding operating cam 32. On the opposite side, each of these tappets 35 has a mushroom shaped stud 39 whose free front face acts on a corresponding bridging contact 20. The center of stud 39 is aligned with the center of its corresponding contact 20. Thus, each tappet 35 deflects the corresponding bridging contact 20 in parallel to the axis of rotation of the operating member 31 and in the opposite direction to the contact closing pressure supplied by spring 22. Since the tappet 35 is not attached to the bridging contact 20 and since, for most of its length it is guided in guide sleeve 36, non-longitudinal forces acting on the tappet 35 due to rotation of the operating member 31 cannot be transmitted to the bridging contact 20. This prevents the bridging contact 20 from shifting sideways or canting so that even after a long period of operation perfect contact between contact rivets 21 and 17 can be guaranteed.

Figure 3:
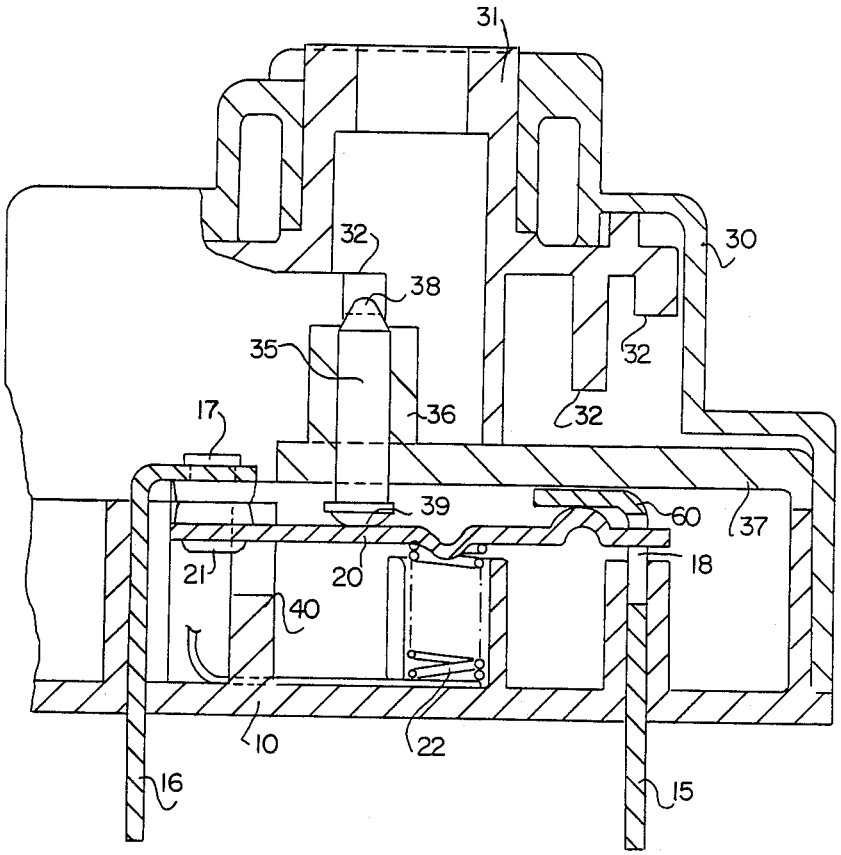
FIG. 3 is a section of the switch taken along the line III—III in FIG. 2.

Each bridging contact 20 is inserted in a corresponding slot 18 in fixed contact 15 (which all bridging contacts have in common) and is therefore guided by that slot. In addition, at the opposite end of each bridging contact 20, close to its corresponding fixed contact, the bridging contact 20 is guided by guide walls 40 extending perpendicularly from base plate 10. The distance between the two guide walls 40 corresponds to the breadth B of the bridging contact 20. FIG. 3, shows that spring 22 acts on bridging contact 20 between its junction with fixed contact 15 and the point at which tappet 35 is applied. Because of this placement of spring 22, a continuous electric connection between the movable bridging contact 20 and the fixed contact 15 ensured. As a result, closing or opening of the electric circuit is performed exclusively by contact rivets 17 and 21, which are designed to interrupt high currents.

Figure 2:
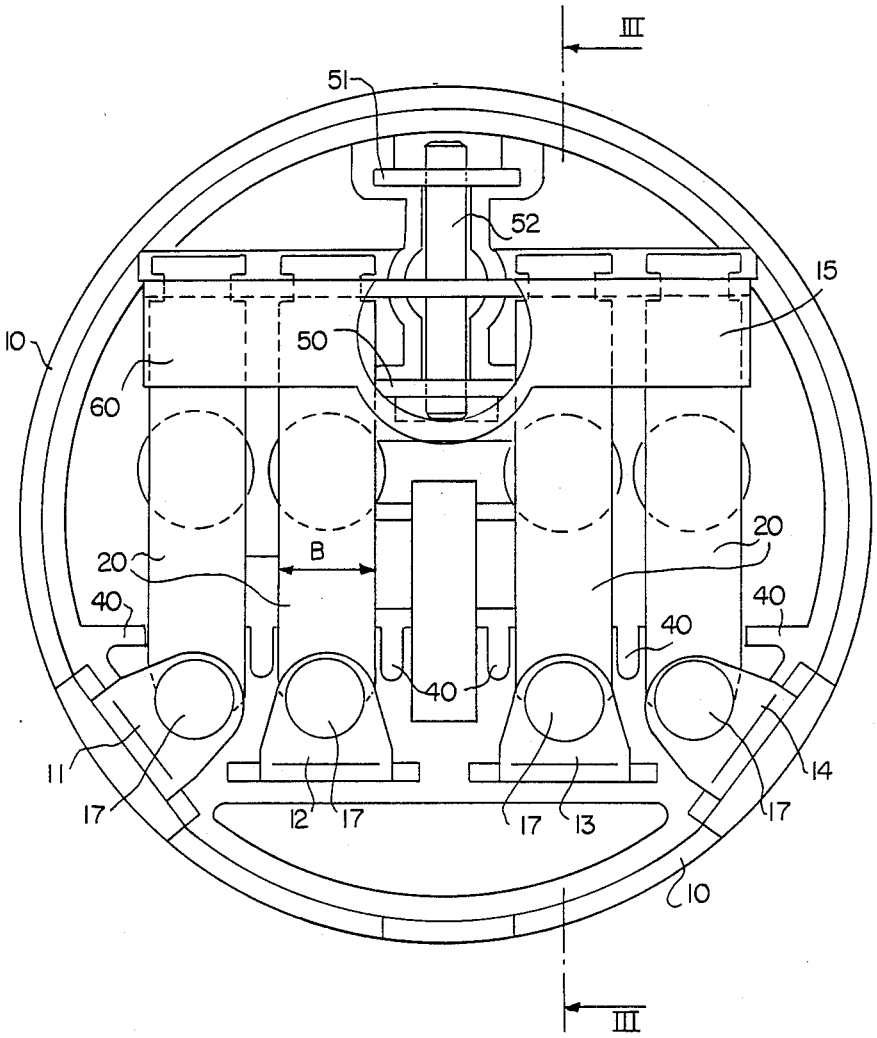
FIG. 2 is a view of the base plate of the switch of FIG. 1.

FIG. 2 shows several bridging contacts 20 arranged in parallel. Each bridging contact is inserted into a corresponding one of several slots 18 of a single fixed contact 15.

FIG. 4 shows several guide sleeves 36 integrally located on a guide plate 37 and along a straight line G. This arrangement requires little space, since the operating cams of operating member 31 are disposed on concentric circles and small switching angles can be used. The mirror-image arrangement of the guide sleeves on the left and right hand sides of a vertical center plane permits two operating cams to be located on the same circular cam path. Using only one guide plate for all tappets reduces assembly difficulties and ensures that all tappets will be arranged in parallel.

FIGS. 1 and 2 show two additional fixed contacts 50 and 51 in base plate 10 which can be electrically connected by a movable cylindrical contact 52. The movable cylindrical contact 52 is operated by a tappet 53 which is guided in another guide sleeve 54 of the guide plate 37. As shown in FIG. 5, guide sleeve 54 extends from guide plate 37 in the opposite direction to the other guide sleeves 36, and nearly reaches movable cylindrical contact 52.

Additional features of the invention improve and prolong the operation of this high-current switch.

As shown in FIGS. 2 and 3, fixed contact 15 which is common to all bridging contacts 20 comprises an angled flange 60 to increase the radiation of heat. In addition, this flange is used as the contact point between movable bridging contacts 20 and fixed contact 15.

The contact tappets 35 are preferably made of plastics that conduct heat poorly but are relatively impervious to high temperatures. This minimizes the amount of heat which may be transmitted from movable bridging contact 20 to guide plate 37 so that it may made of a cost saving material that is less temperature-proof.

In the embodiment according to FIGS. 1 to 6, there is only one contact point between common fixed contact 15 and movable bridging contact 20. FIG. 7 shows the attachment of the movable bridging contacts 20 to the common fixed contact 15 in an alternative preferred embodiment. Movable bridging contact 20 has a bow-shaped part 80 which extends through slot 18 in fixed contact 15. Thus, movable bridging contact 20 touches fixed contact 15 at two contact points (labelled X). Since this junction is not equipped with precious-metal contacts, the conductance of the junction is improved by the additional contact point.

Some ignition starter switch applications require a "buzzer" contact via which only low currents are to be transmitted. A movable leaf-spring contact 95 is positioned in proximity to a fixed contact 96 anchored in the base plate. A two-piece operating element 90 is axially disposed within rotatable operating member 31. Operating element 90 comprises a cup-shaped part 91 resiliently supported against an opposing part 92 by spring 93. The operating force received by part 91 is transmitted to opposing part 92 through spring 93. Opposing part 92 presses leaf spring contact 95 against fixed contact 96. By using such a resilient operating element 90 the contact pressure is essentially independent of the operating force. This technique could also be applied to switches of other types.

What is claimed is:

1. An electric ignition starter switch for motor vehicles comprising:

at least two independent fixed contact means, each of said independent fixed contact means being electrically independent of one another;

a common fixed contact means having at least two cable attachment means, each for connecting a separate electric cable to said common fixed contact means;

base plate means for securing said independent fixed contact means and said common fixed contact means;

a plurality of movable bridging contact means for intermittently electrically connecting said common fixed contact means to said independent fixed contact means, each of said movable bridging contact means corresponding to one of said independent fixed contact means and capable of movement toward said corresponding independent fixed contact means, said movable bridging contact means being in continuous electrical connection with said common fixed contact means, said movable bridging contact means being arranged in parallel;

rotatable operating means for carrying a plurality of cams located on a surface thereof, said rotatable operating means turning about an axis of rotation;

a plurality of axially displaceable tappet means, each tappet means corresponding to one of said movable bridging contact means for conducting operating force from said cams of said rotatable operating means to said corresponding movable bridging contact means thereby urging said corresponding movable bridging contact means toward its corresponding independent fixed contact means to complete an electrical circuit between said corresponding independent fixed contact means and said common fixed contact means;

a plurality of guide sleeves for preventing the displacement of said tappets in a direction other than parallel to the axis of rotation of said rotatable operating means; and guide plate means for supporting said guide sleeves.

2. A switch according to claim 1, wherein the tappet is guided in a guide sleeve as a separate part that is not attached to the bridging contact.

3. A switch according to claim 2, wherein the tappet acts on the bridging contact means only by means of one of its free front faces, and wherein said bridging contact means is guided in parallel to the axis of rotation of the operating member by guide walls extending from the base plate.

4. A switch according to claim 2, further comprising resilient means for providing force opposing the movement of said movable bridging contact means toward said independent fixed contact means; and wherein said movable bridging contact is rigid.

5. A switch according to claim 4, wherein:

an end of each of said movable bridging contact means is inserted into a corresponding opening in said common fixed contact means at a first reference position on said movable bridging contact means;

said tappet is applied to said movable bridging contact means at a second reference position on said movable bridging contact means; and said resilient means acts on said movable bridging contact means between said first and second reference positions.

6. A switch according to claim 2, wherein said common fixed contact means further comprises flange means, disposed essentially in parallel to the movable bridging contact means, for increasing the radiation of heat.

7. A switch according to claim 2, wherein said guide plate means comprises a single guide plate which supports several guide sleeves.

8. A switch according to claim 7, wherein several guide sleeves are located along a straight line on the guide plate and wherein at least one of said cams corresponds to each of the tappets guided in said guide sleeves, said cams being disposed on concentric circles with different radii.

9. A switch according to claim 2, wherein the tappets are made of plastic heat-proof materials which conduct heat poorly.

10. A switch according to claim 2, wherein each guide sleeve extends from the guide plate means to terminate in close proximity to the corresponding movable bridging contact means.

11. A switch according to claim 10, wherein at least one guide sleeve extends from the guide plate means in the direction opposite the movable bridging contact means.

12. A switch according to claim 2, wherein said movable bridging contact means further comprises a bow-shaped part penetrating a slot in said common fixed contact means and wherein said movable bridging contact means touches said common fixed contact means at two contact points.

13. A switch according to claim 2, wherein said rotatable operating member includes an axially movable operating element comprising an upper part, a lower part, and resilient means separating the upper part and the lower part, for pressing a movable contact spring onto a fixed contact.

* * * * *